United States Patent [19]

Mackenzie

[11] 4,262,838

[45] Apr. 21, 1981

[54] FILE FOLDER ASSEMBLY HAVING REMOVABLE COVER

[76] Inventor: John R. Mackenzie, 3001 Tomahawk Rd., Mission Hills, Kans. 66208

[21] Appl. No.: 971,310

[22] Filed: Dec. 20, 1978

[51] Int. Cl.[3] ..... B65D 27/08

[52] U.S. Cl. ..... 229/72; 229/1.5 R; 229/DIG. 3

[58] Field of Search ..... 150/7, 42, 28 A; 229/DIG. 3, 1.5 R, 68 R, 72; 40/359

[56] References Cited

U.S. PATENT DOCUMENTS

| | | | |
|---|---|---|---|
| 499,906 | 6/1893 | Carnahan . | |
| 851,546 | 4/1907 | Mudd , | |
| 1,048,577 | 12/1912 | Pardoe, Jr. . | |
| 1,206,442 | 11/1916 | Johnson | 229/68 R |
| 1,552,303 | 9/1925 | Hubbard | 229/72 |
| 1,585,237 | 5/1926 | Doughty . | |
| 1,613,570 | 1/1927 | Shotwell | 229/72 |
| 1,677,142 | 7/1928 | Engel-Kron et al. | 150/28 A |
| 1,728,574 | 9/1929 | Reese . | |
| 1,747,801 | 2/1930 | Topal | 150/28 A |
| 1,984,150 | 12/1934 | Ottinger | 150/7 |
| 2,050,308 | 8/1936 | Gash . | |
| 2,151,469 | 3/1939 | Hochtheil | 229/72 |
| 2,188,730 | 1/1940 | Swab | 229/68 R |
| 2,756,515 | 7/1956 | Hoffman | 35/35 |
| 2,784,756 | 3/1957 | Resnick | 150/28 A |
| 3,977,451 | 8/1976 | Duba | 150/7 |

FOREIGN PATENT DOCUMENTS

| | | | |
|---|---|---|---|
| 1266958 | 6/1961 | France | 229/72 |
| 223823 | 10/1924 | United Kingdom | 150/28 A |

*Primary Examiner*—Stephen P. Garbe

*Attorney, Agent, or Firm*—Schmidt, Johnson, Hovey & Williams

[57] ABSTRACT

An improved file folder assembly having an expansible, normally open-top paper-receiving section and a completely removable top cover is provided which allows storage of a number of open top sections for ease of access to the contents thereof while permitting removal of an individual folder and attachment of a top cover thereto during transport and use of the file. In this manner a relatively small number of covers can be maintained for a very large number of file sections, in order to lower costs. The covers are preferably secured to individual folder sections by provisions of mated hook and eye strips respectively mounted on the file sections and covers. On one side of the assembly the attachment strips are vertically and centrally oriented in order to accommodate varying quantities of filed papers, while on the remaining side the strips are horizontally mounted. The uncovered sections can thus be stored in side-by-side relationship and interference between adjacent attachment strips is avoided.

10 Claims, 6 Drawing Figures

FILE FOLDER ASSEMBLY HAVING REMOVABLE COVER

BACKGROUND OF THE INVENTION

1. Field of the Invention

The present invention is broadly concerned with an improved file folder assembly having particular utility in insurance offices and the like wherein a large number of files need to be maintained for ready reference and review. More particularly, it is concerned with such a file folder assembly which includes an open top, expansible, paper-receiving section along with a completely removable top cover which can be secured to the paper-receiving section during transport and use of the file to maintain the confidentiality and prevent loss of the contents of the file.

2. Description of the Prior Art

The most common file folder in use today is a simple foldable cover having open ends which serves, at least to a certain extent, to maintain the contents of the file separate from those of other files. These cover-type file folders are stored either in drawers or in side-by-side relationship on shelves. While such files are in widespread use, there are a number of problems associated therewith. First, by virtue of the fact that the contents of the folder are not fully enclosed, it is very possible to lose portions of the files during use thereof. Second, and perhaps more important in a case of confidential documents such as those found in insurance agency files, covertype folders offer no protection against unwanted viewing of the contents of the file. For example, when such a folder is taken from storage and used in the field, the contents thereof can be readily seen by anyone in the vicinity of the folder.

It has also been suggested in the past to employ fully enclosable file folders which include spaced side and end panels, a bottom panel, and normally a cover flap which can be tied in place by means of a securement string or the like. While these types of file folders overcome many of the problems noted above, they are objectionable on several grounds. First, the cost thereof is prohibitive, especially to a business having a large number of files. Secondly, when the folders are placed in storage on shelves, it is very desirable that the contents thereof be readily accessible to office personel. This in turn means that the cover flaps of the respective folders should be left open, but this creates problems inasmuch as the flaps of adjacent folders can interfere with one another and effectively block access to the contents of the individual files. At the same time, closing all of the folders necessitates removal of each file from its storage position and opening of the secured in place cover to gain access to the contents of the file. Obviously, this is a troublesome and time-consuming task.

Other types of file folder assemblies are disclosed in U.S. Pat. Nos. 499,906, 851,546, 1,585,237, 1,728,574, 1,048,577, 2,050,308, and 2,756,515.

SUMMARY OF THE INVENTION

The file folder assembly of the present invention broadly includes a normally open top paper-receiving section which has a pair of generally rectangular side panels, end panels interconnecting the side panels, and a bottom panel. A cover is provided for selectively closing the open top of the paper-receiving section, along with means for releasably securing the cover to the section as desired, for example when an open top section is pulled from its normal storage space for transport and use.

Preferably, the attachment means for the cover includes first and second pairs of cooperating attachment structures respectively secured to the side panels of the paper-receiving section, and to the cover itself. In practice, elongated, mated hook and eye strips are particularly effective. Such material is sold under the trade designation "velcro." Also, it is preferred to mount the first pair of hook and eye strips generally vertically on one side panel of the section and cover, with the second pair thereof being horizontally located on the opposite side panel and cover. In this fashion the paper-receiving sections can be placed in side-by-side relationship on a support shelf or the like with a minimum of interference between the attachment strips on the respective sections.

A plurality of compartment-defining planar sheets are preferably disposed within the paper-receiving section, with each sheet including an upstanding tab; the tabs on respective sheets are prefereably displaced laterally relative to one another, so as to facilitate reading of labels or other informational data on the individual tabs.

DESCRIPTION OF THE PREFERRED EMBODIMENT

Turning now to the drawings, a file folder assembly 10 in accordance with the invention broadly includes a normally open-top paper-receiving section 12, a cover 14 for selectively closing the open top of the section 12, and means broadly referred to by the numeral 16 for releasably securing cover 14 to the section 12.

Figure 1:
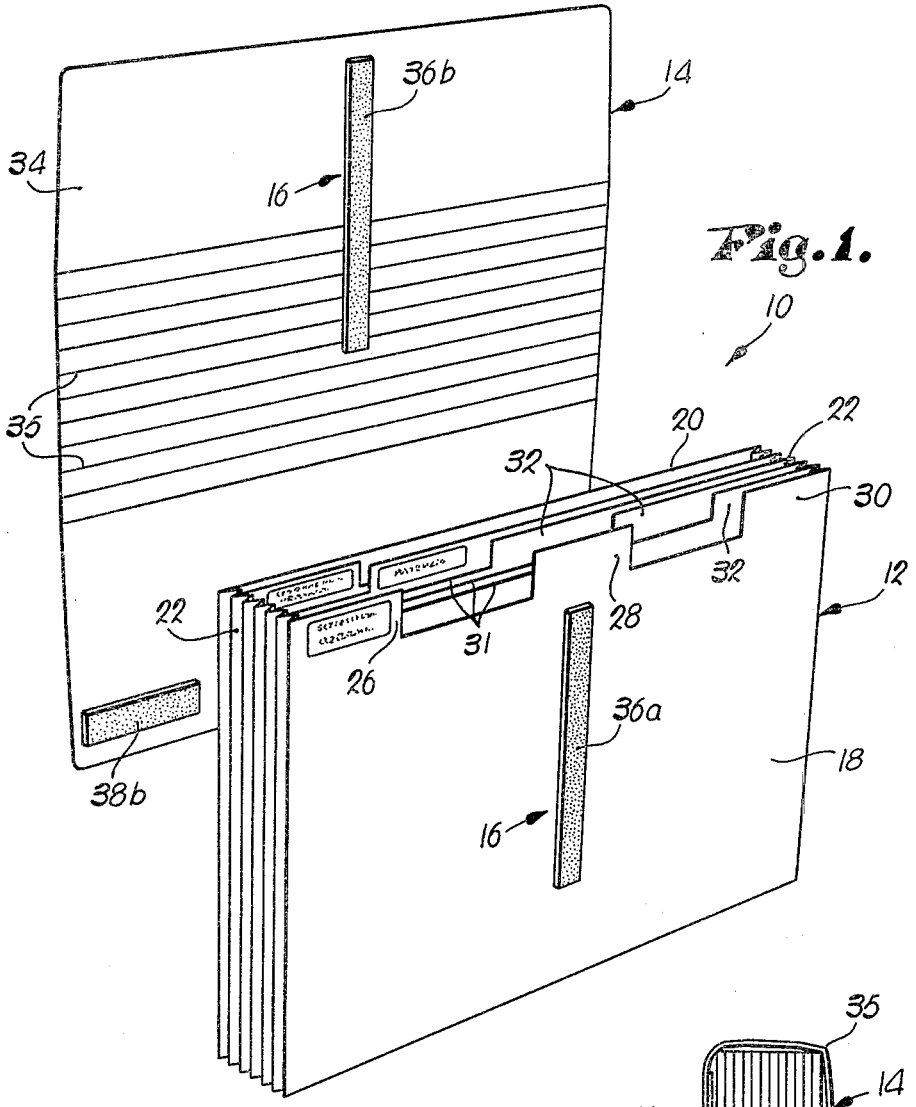
FIG. 1 is a perspective view of a file folder assembly in accordance with the invention, shown with a removable cover separate from the paper-receiving section thereof.
Figure 4:
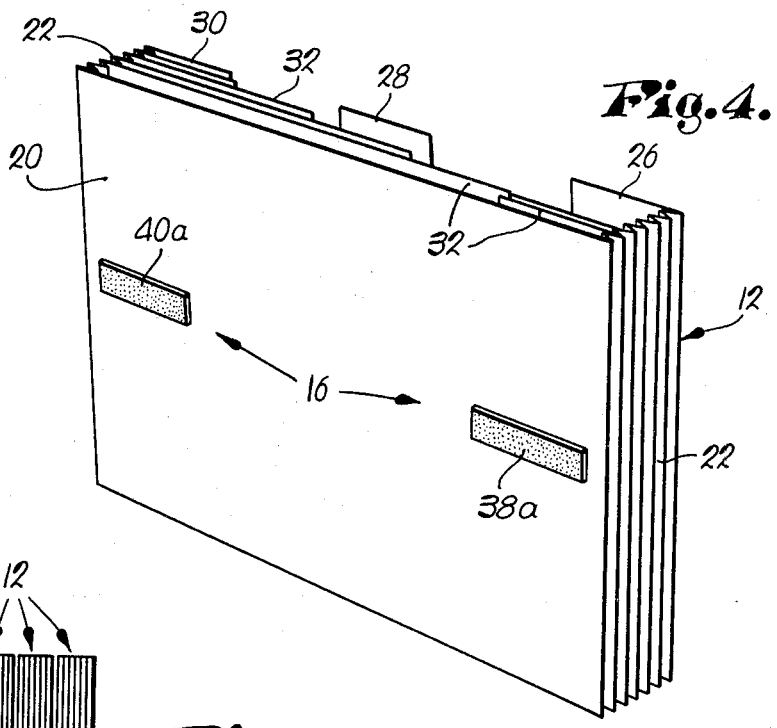
FIG. 4 is a perspective view of the paper-receiving section of the overall file folder assembly, and particularly illustrating the side panel of the section having a pair of laterally spaced, horizontally disposed attachment strips thereon corresponding to the cover-mounted strips illustrated in FIG. 3.

Section 12 includes a pair of generally rectangular, spaced side panels 18 and 20, accordion folded end panels 22, and an accordion folded bottom panel 24. As best seen in FIGS. 1 and 4, side panel 18 is provided with three upstanding, rectangular, laterally spaced tabs 26, 28 and 30 which are adapted to receive labels or other informational data. On the other hand, spaced side panel 20 is of essentially rectangular configuration, does not have upstanding tab, and in effect defines a unitary back wall for the section 12. As will be readily apparent, the accordion-folded nature of the panels 22 and 24 renders the section 12 expansible for receiving various quantities of papers or documents.

A plurality of individual, planar, compartment-defining sheets 31 are disposed within the cavity defined by the section 12 for the purpose of subdividing the latter into a series of individual paper-receiving compartments. Each of the sheets 30 is provided with a upstanding, integral, rectangular tab 32 for informational data. As best seen in FIG. 1, the respective tabs on adjacent sheets 31 are laterally displaced relative to one another in order to facilitate reading of the data on each tab.

Figure 2:
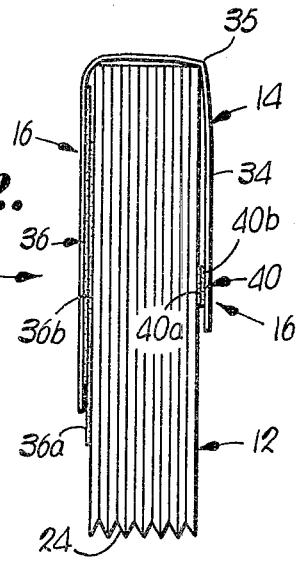
FIG. 2 is an end elevational view of the file folder assembly illustrated in FIG. 1, showing the top cover operatively secured to the paper-receiving section.

Cover 14 comprises a somewhat rectangular sheet of material 34 having rounded corners and a plurality of spaced, transversely extending lines of weakness 35. The sheet 34 is dimensioned to fit over and essentially cover the normally open top of the section 12; and the centrally located lines of weakness 35 facilitate folding of the cover 14 over the open top of the section as best illustrated in FIG. 2.

Securing means 16 in the illustrated embodiment includes three mated pairs of "Velcro" material hook and eye strips 36, 38 and 40. For ease of discussion, the section-mounted strips of each pair thereof shall be designated 36*a*, 38*a* and 40*a*; likewise, the cover-mounted strip shall be designated 36*b*, 38*b* and 40*b*.

Figure 5:
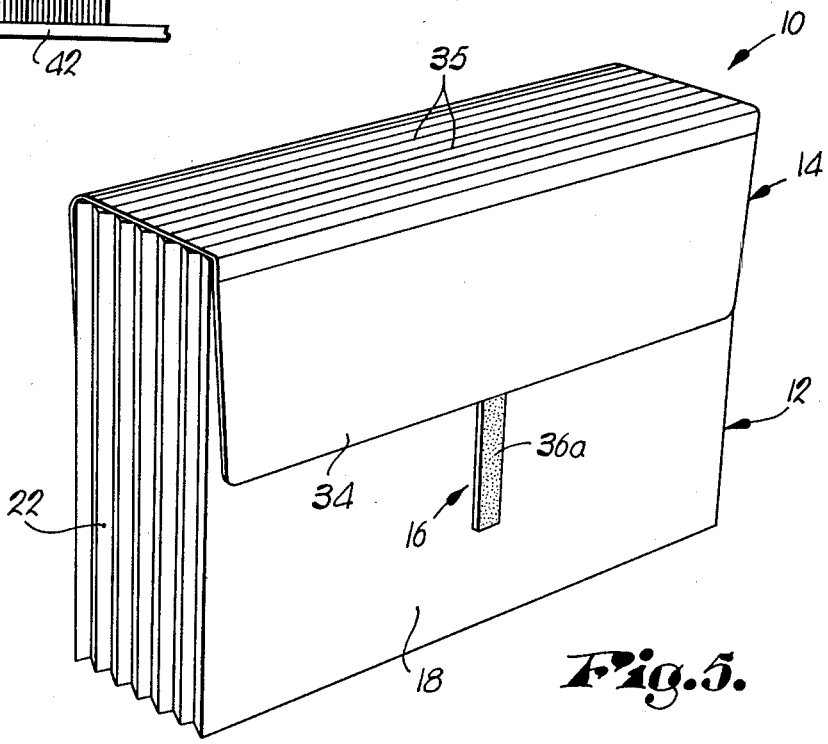
FIG. 5 is a perspective view of the file folder assembly, shown with the top cover thereof operatively secured to the paper-receiving section, and illustrating the side of the section opposite to that shown in FIG. 4.

Referring now to FIGS. 1, 4 and 5, it will be seen that strip 36*a* is disposed vertically on the panel 18 (when the section 12 is in a bottom-down position), and the corresponding strip 36*b* is likewise vertically oriented. It will be noted in this respect that the strips 36*a*, 36*b* are essentially centrally located between the opposed ends of the assembly 10.

Figure 3:
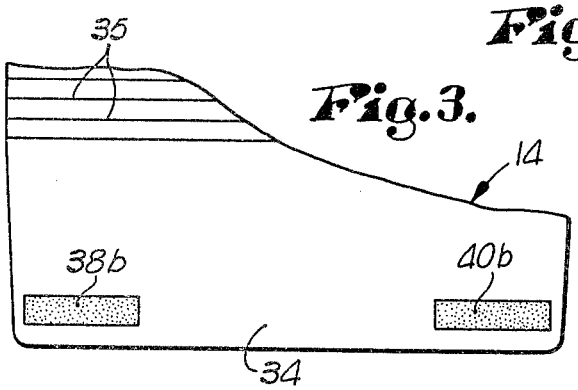
FIG. 3 is a fragmentary, elevational view depicting a pair of laterally spaced, horizontally oriented attachment strips mounted on the top cover of the file folder assembly.

The strip pairs 38 and 40 are located in laterally spaced relationship to each other and to the corresponding strips 36*a*, 36*b*, and are oriented generally transversely relative to the latter. Specifically, the strips 38*b*, 40*b* are located in laterally spaced relationship adjacent the outer margins of the sheet 34 (see FIG. 3). Similarly, the strips 38*a*, 40*a* are oriented in a generally horizontal relationship and are spaced on the side panel 20.

Figure 6:
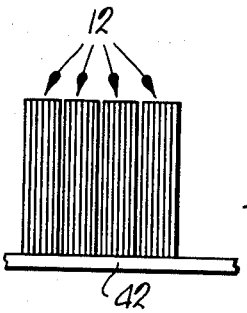
FIG. 6 is an elevational view of a plurality of paper-receiving sections mounted in side-by-side relationship on a support shelf.

The use of a plurality of assemblies 10 in a filing system is as follows. First, during normal day-to-day operations, a plurality of open top sections 12 will be located in side-by-side relationship on a support surface such as a drawer bottom or shelf 42 (see FIG. 6). In this regard it is preferable to place the sections 12 such that the side panel 20 of each section is adjacent to the panel 18 of the next section. In this manner, interference between the velcro strips 36*a* mounted on the panels 18, and the strips 38*a* and 40*a* mounted on the panels 20, is essentially completely avoided. In this juxtaposed orientation, access to the respective sections 12 is greatly facilitated inasmuch as there are no cumbersome attached covers or the like which tend to impede working with the contents of the file folder sections. Moreover, by virtue of the compartments defined by the internal sheets 31, as well as the informational tabs associated therewith, office personnel can tell at a glance where to file or retrieve given types of documents.

When it is desired to remove a file for transport and/or use thereof, the appropriate section 12 is removed from its normal storage position, and a cover is attached thereto. This simply involves pressing the mating strips 38*b*, 40*b* on cover 14 into engagement with the corresponding strips 38*a*, 40*b* secured to side panel 20 of the section 12. The free end of the cover can then be pulled across the open top of the section 12, whereupon vertically oriented strip 36*b* is pressed into operative engagement with the similarly oriented strip 36*a* mounted on side panel 18. It will be noted in this respect that the vertical orientation of the strips 36*a*, 36*b*, allows use of the cover 14 on files of varying thickness, because of the fact that the strip 36*b* can be secured to the corresponding strip 36*a* at any point along the length of the latter. In its operative disposition, cover 14 completely protects the confidentiality of documents within the folder assembly 10. Moreover, risk of loss is greatly minimized because of the effective attachment of the cover 14 to the section 12. When the use of the file is completed the cover 14 is simply detached from the section 12, and the latter is put back into file storage.

By virtue of the fact that any cover 14 can be used with any section 12 in a given filing system, it is only necessary to stock a relatively small number of the covers 14 for a large number of sections 12. This in turn represents a real savings to the user and facilitates use of the folder assemblies as described above.

Having thus described the invention, what is claimed as new and desired to be secured by Letters Patent is:

1. A file folder assembly comprising:

a plurality of open-top, paper-receiving sections, each section being provided with a pair of generally rectangular side panels, end panels interconnecting said side panels, and a bottom panel, said sections being removably located in side-by-side relationship to one another on a support surface for ease of access to the contents thereof;

a number, lesser than said plurality, of top covers for said sections; and means for selectively and releasably securing one of said top covers to a selected one of said sections individually and in a disposition for covering the open top of the latter, when said selected section is removed from said support surface for transport and use thereof.

2. The system as set forth in claim 1 wherein each of said covers comprises a sheet of material configured to cover the open top of a selected one of said sections individually, said securing means being located for releasably attaching the distal ends of said sheet respectively to the side panels of a selected one of said paper-receiving sections.

3. The system as set forth in claim 2 wherein said securing means comprises cooperating pairs of elongated separable strips of hook and eye material, each of said side panels of each section having at least one strip of said material thereon, corresponding mating strips for each panel-mounted strips being mounted on each cover.

4. The system as set forth in claim 3 wherein one of said panel-mounted strips is disposed generally vertically on a first side panel of each section when it is in a bottom-down position on said support surface, the corresponding cover-mounted strip being attachable to said vertically disposed strip at any point along the length of the latter, whereby said cover can accommodate and tightly cover a corresponding section when the latter is filled to varying thicknesses.

5. The system as set forth in claim 4 wherein the other panel of each section is provided with at least one strip which is oriented generally transverse relative to said vertically disposed strip or a respective cover.

6. The system as set forth in claim 5 including a pair of transversely oriented strips mounted on each cover is spaced relationship to one another and said vertically disposed strip thereon.

7. The system as set forth in claim 6 wherein said plurality of sections are located on said support surface with the first side panels of each section being adjacent to the other side panels of the next adjacent sections, said generally transverse strips being spaced from said generally vertical strips to avoid contact between the same.

8. A file folder assembly, comprising:

a normally open-top paper-receiving section having a pair of generally rectangular side panels, end panels interconnecting the side panels, and a bottom panel;

a cover for selectively closing the open top of said section;

means for releasably securing said cover to said section for closing said open top, said securing means comprising a first pair of cooperating attachment structures respectively secured to one of said side panels and said cover, a second pair of cooperating attachment structures respectively secured to the other side panel and said cover, said pairs of attachment structures being respectively, elongated, mated hook and eye strips, the panel-mounted strip of said first pair thereof being elongated and oriented generally vertically, when said section is positioned bottom down on a horizontal support surface, the remaining strip of said first pair thereof being attachable to the panel-mounted strip at any point along the length of the latter, the panel-mounted strip of said second pair thereof being oriented transverse relative to the panel-mounted strip of the first pair thereof and spaced horizontally from the latter; and a third pair of elongated, mated hook and eye strips secured respectively to the other side panel and cover, the panel-mounted strip of said third pair being oriented transverse to the panel-mounted strip of the first pair, said panel-mounted strips of said second and third pairs thereof being spaced from each other and said vertically oriented strip, and respectively located on the opposite sides of the latter.

9. The folder assembly as set forth in claim 8 wherein said end and bottom panels are accordion folded for rendering said section expansible.

10. The folder assembly as set forth in claim 8 wherein said section includes a plurality of individual, planar, compartment-defining sheets, each of said sheets having an upstanding tab along the upper edge thereof for receiving informational data, the tabs on adjacent sheets being laterally displaced for facilitating reading of said informational data on each tab.

* * * * *